United States Patent [19]

Casey

[11] 4,099,503

[45] Jul. 11, 1978

[54] MEANS FOR IMPARTING SUPERSONIC FLOW CHARACTERISTICS IN THE INTAKE MANIFOLD OF AN INTERNAL COMBUSTION ENGINE

[75] Inventor: Edward H. Casey, St. Louis, Mo.

[73] Assignee: ACF Industries, Inc., New York, N.Y.

[21] Appl. No.: 727,719

[22] Filed: Sep. 29, 1976

[51] Int. Cl.[2] ..... F02M 31/00

[52] U.S. Cl. ..... 123/122 AB; 123/122 AC; 123/141; 261/65

[58] Field of Search ..... 123/122 AB, 122 AC, 123/141, 119 E; 261/65

[56] References Cited

U.S. PATENT DOCUMENTS

| | | | |
|---|---|---|---|
| 1,676,955 | 7/1928 | Kemp | 123/122 AC |
| 3,892,214 | 7/1975 | Heidacker | 123/122 AB |
| 4,008,699 | 2/1977 | Braun | 123/122 AB |

FOREIGN PATENT DOCUMENTS

| | | | |
|---|---|---|---|
| 498,706 | 9/1954 | Italy | 261/65 |

*Primary Examiner*—Ronald H. Lazarus

[57] ABSTRACT

A combustible mixture of air and minute fuel droplets is produced for supply to the cylinders of an internal combustion engine. The engine includes a carburetor having a main air passageway in it, and an intake manifold interposed between the engine and the carburetor. The intake manifold includes at least one wall defining a plurality of fluid passageways operatively connected to the carburetor and to the combustion chambers of the engine. A throttle structure is mounted in the intake manifold. The combustible mixture is formed by introducing liquid fuel into a stream of intake air and uniformly distributing the fuel in the air by passing the air and fuel mixture through a constriction to increase the velocity of the mixture to sonic speed. The constriction occurs at the throttle structure in the manifold. The area of constriction and the amount of the fuel entering the air stream are adjustable for correlation with engine demand. After passing through the constriction, the air/fuel mixture is accelerated to supersonic velocity and thereafter decelerated to subsonic velocity to produce a shock zone where the fuel droplets are believed to be further subdivided. The supersonic and subsonic mixture speeds are obtained at the outlet of the throttle structure in the manifold. Thereafter, the mixture is inducted into the combustion chambers of the engine. Preferably, the throttle structure includes a tubular device having at least one end movably mounted in the intake manifold. A plate either is suspended in or forms a part of the intake manifold. The plate and tubular structure coact to provide the constriction, supersonic and subsonic zones of mixture flow.

11 Claims, 7 Drawing Figures

MEANS FOR IMPARTING SUPERSONIC FLOW CHARACTERISTICS IN THE INTAKE MANIFOLD OF AN INTERNAL COMBUSTION ENGINE

BACKGROUND OF THE INVENTION

This invention relates to internal combustion engines, and in particular, to an improved throttle structure for controlling fuel input to the combustion chambers of the engine, and for mixing and modulating liquid fuel and intake air in order to reduce undesirable exhaust emissions from such engines.

In combustion engines prevalent today, the combustion chambers of the engine are connected to a source of fuel and a source of air through an intake manifold and a carburetor. The carburetor has a main air passageway extending through it, and a venturi restriction is used to draw fuel into the air stream. Control of the flow through the air passageway is obtained through the use of a throttle valve. The throttle valve conventionally has been a butterfly valve type of device.

It long has been known that the combustion chambers of an engine receive varying amounts of fuel during operation of the engine. Ideally, each intake stroke of the piston would draw a fuel/air mixture into a particular combustion chamber which would burn completely during the power stroke of the piston. Unfortunately, fuel distribution does not match the ideal. The reasons for unequal distribution also generally are known. Thus, when the fuel/air mixture strikes a conventional throttle valve, large droplets of fuel often are formed. Large fuel droplets do not move readily to the combustion chambers, and distort the fuel/air ratio when they do arrive. In addition, the throttle valve commonly is pivotally mounted across the diameter of the carburetor air passageway. Fluid movement past the throttle is unbalanced or directed toward one side or the other of the passageway by the very presence of the throttle valve. Although some mixing of the two air streams imposed by the throttle valve does occur below the throttle valve, the asymmetrical distribution of the fuel and the intake air rarely is overcome completely.

A number of attempts have been made to improve the consistency of the air/fuel mixture delivered to the cylinders in an internal combustion engine. In general, prior art attempts involve complicated redesigns of the fuel/air delivery system, for example, by the use of fuel injection mechanisms, or complicated redesigns of the engine. While such systems and designs work for their intended purposes, they are expensive to produce initially, and often are expensive to maintain in normal operation and use.

An example of an improved throttle structure with which the invention disclosed hereinafter is compatible is disclosed in a co-pending application by James T. Bickhaus, "Throttle Structure for an Internal Combustion Engine," Ser. No. 727,713, filed 9/29/76. An invention dealing with subject matter related to that described herein is disclosed in a co-pending application by Donald L. Hicks, "Throttle Structure for Imparting Supersonic Flow Characteristics in the Intake Manifold of an Internal Combustion Engine," Ser. No. 727,718, filed 9/29/76. Both applications are assigned to the assignee of the present invention. General information disclosed in these co-pending applications is intended to be incorporated by reference.

The invention disclosed hereinafter provides an improved throttle means for a conventional carburetor, which accomplishes supersonic flow with simplified structure. As described more fully hereinafter, the incoming fuel and air mixture, in one embodiment of the invention, is permitted to strike the bottom wall of the intake manifold of the engine. A throttle means, which may be similar to that described in the above-referenced Bickhaus application, Ser. No. 727,713, filed 9/29/76, in conjunction with the bottom wall, is utilized to regulate fluid flow in accordance with engine demand. The throttle means and intake manifold are arranged so that fluid flow through the throttle passes through a restriction for obtaining sonic flow, and a diverging portion which imparts supersonic and then subsonic flow to the mixture.

Devices and methods for obtaining supersonic flow in the fuel supply system of internal combustion engines also are known in the art. For example, the U.S. Pat. No. 3,778,0388 to Eversole, issued Dec. 11, 1973, describes a particular approach to obtaining such supersonic flow.

In distinction to prior art designs, this invention accomplishes supersonic flow with little modification either to the conventional carburetor structure or to the conventional intake manifold.

One of the objects of this invention is to provide a throttle structure for an internal combustion engine which gives a better fuel/air mixture distribution to the cylinders of the engine.

Another object of this invention is to provide a throttle valve structure having an inlet side and an outlet side, the outlet side being positioned in the inlet manifold of an internal combustion engine.

Another object of this invention is to provide a throttle valve structure which utilizes a tubular body member as the valve element.

Yet another object of this invention is to provide a throttle valve structure which imparts supersonic flow to the fuel mixture passing through it.

Yet another object of this invention is to provide a throttle structure imparting supersonic flow characteristics to the fluid mixture passing through it, without requiring major design changes in either the carburetor or the intake manifold of the engine.

Other objects of this invention will be apparent to those skilled in the art in light of the following description and accompanying drawings.

SUMMARY OF THE INVENTION

In accordance with this invention, generally stated, an internal combustion engine having an intake manifold operatively connected to the combustion chambers of the engine, and a carburetor operatively connected to the intake manifold, is provided with a throttle having an inlet and an outlet, the outlet being positioned within the intake manifold. In the preferred embodiment, the throttle includes a movably mounted tubular member. The end of the tubular member within the intake manifold, together with structure means in the passageway of the intake manifold, define a converging section terminated in a restriction, followed by a diverging section opening into the main flow passageway of the intake manifold. Fluid enters the tubular member from the carburetor and is directed against the structure means in the manifold. Flow of the fluid after striking the structure means may proceed radially outwardly in all directions in a much more even flow pattern than possible with prior art throttle valves. As the fluid flow moves radially outwardly, it passes through the restriction defined by the tubular member and the structure means. Thereafter, it enters the diverging section to produce a shock zone, which is believed to break up any large particles of fluid in the mixture, in turn permitting a more even flow distribution to the combustion chambers of the engine.

DESCRIPTION OF THE PREFERRED EMBODIMENT

Figure 1:
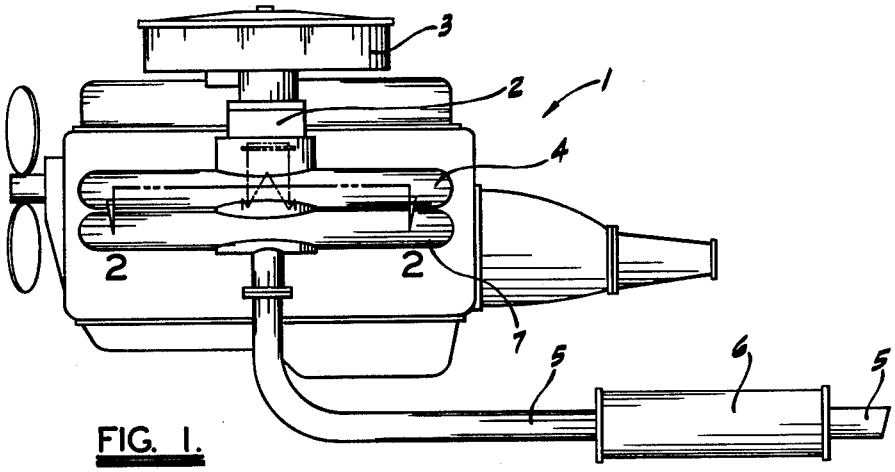
FIG. 1 is a view in side elevation, partly broken away, of an internal combustion engine utilizing a carburetor employing a throttle structure of this invention.

Referring now to FIG. 1, reference numeral 1 indicates an internal combustion engine, including a carburetor 2 connected to a source of air through air cleaner 3. The carburetor 2 also is operatively connected to the combustion chambers of the engine 1 through an intake manifold 4, while exhaust gas from the combustion chambers of the engine 1 is connected to a tail pipe 5 and a muffler 6, through an exhaust manifold 7.

Figures 5, 5A, 6:
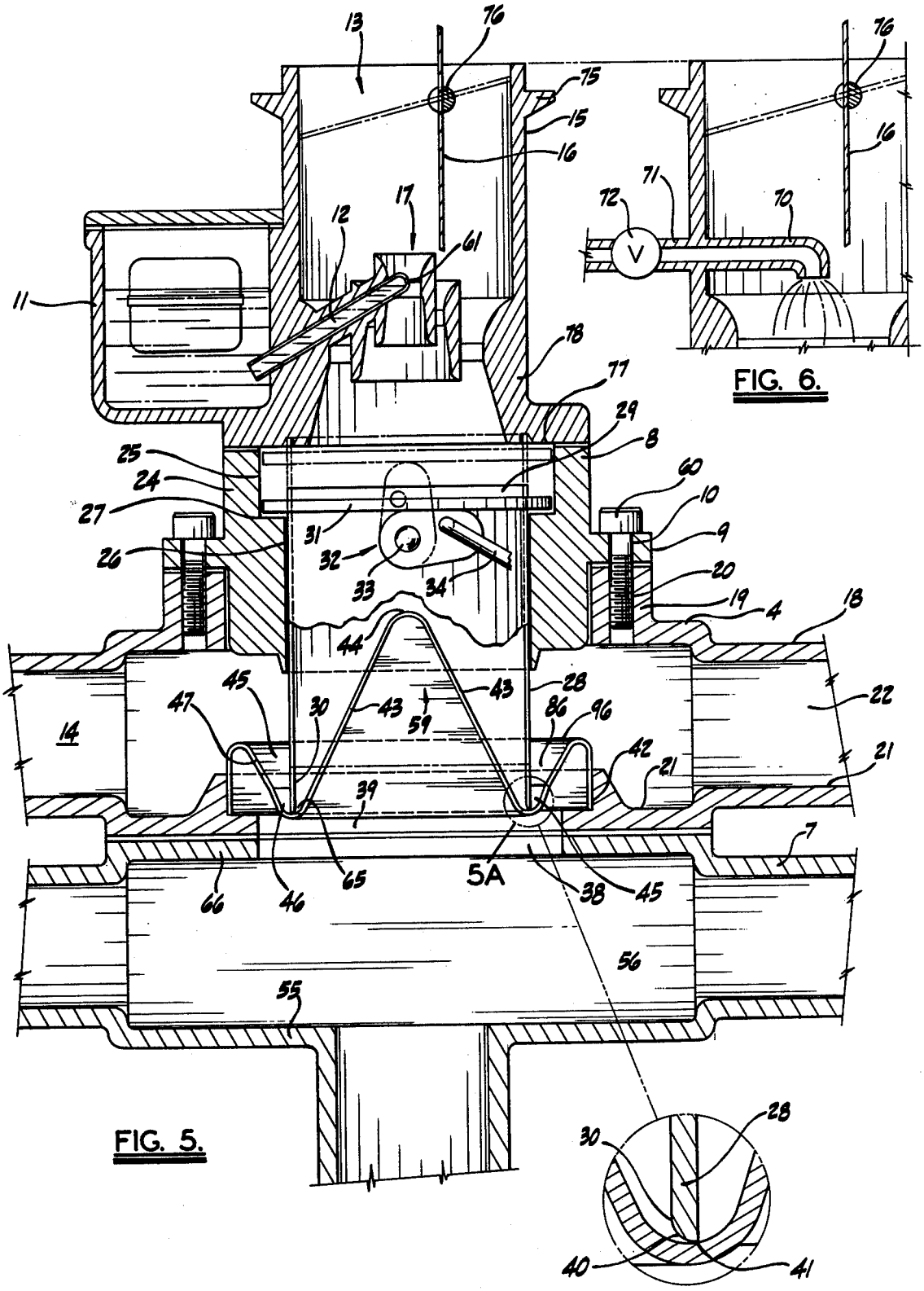
FIG. 5 is an enlarged sectional view, partly broken away, of a carburetor employing a third illustrative embodiment of throttle valve structure of this invention.
FIG. 5*a* is an enlarged view taken about the area 5*a* of FIG. 5.
FIG. 6 is a sectional view, partly broken away, showing a second illustrative fuel supply system for the carburetor shown in FIG. 5.

The carburetor 2 structure not forming a part of this invention is best illustrated in FIG. 5, where it may be observed that the carburetor 2 conventionally includes a housing 8 having a flange 9 extending outwardly from it. The flange 9 is provided with suitable openings 10 for mounting the housing 8 to the intake manifold 4 with conventional threaded fasteners 60 inserted in corresponding openings in the intake manifold 4. A main air passage 13 extends through the housing 8 and communicates with a distribution passage 14 in the intake manifold 4. The carburetor 2 also has a fuel bowl 11 associated with it, which is operatively connected to the main air passage 13 along a main fuel passageway 12. The upper portion of the carburetor 2 structure defines an air horn 15. The air horn 15 commonly includes a flange 75 for receiving the air cleaner 3, shown in FIG. 1. Those skilled in the art will recognize various structural features of the carburetor 2 may be formed integrally with one another, or they may be constructed independently and interconnected by any convenience method.

A conventional butterfly choke valve 16 is pivotally mounted in the passage 13 at 76, upstream of a venturi section 17. The valve 16 operates to control the amount of air entering the passage 13 during various operating conditions of the engine 1. The operation and structure of the choke valve 16 is conventional. Consequently, it is not described in detail.

As indicated, the passageway 12 extends between the fuel bowl 11 and the passage 13, communicating with the passage 13 at the venturi section 17. Venturi section 17 also is conventional, and is not described in detail. In general, a restriction 61, provided at the venturi section 17, causes a pressure drop to exist within the venturi section, enabling the air rushing through the passage 13 to draw fuel from the fuel bowl 11 via the passageway 12.

Manifold 4 generally includes a top wall 18 having an annular rim 19 integrally formed with it. The rim 19 defines an opening 20 through the top wall 18, which permits communication between the carburetor passage 13 and the manifold distribution passage 14. The intake manifold 4 also includes a bottom wall 21 and a pair of side walls 22. The top wall 18, bottom wall 21 and side walls 22 define a plurality of inlet ports 23, best seen in FIG. 2, communicating with the combustion chambers of the engine. For drawing simplicity, the combustion chambers themselves are not shown. While the manifold 4 is illustratively described as having top, bottom and side walls, those skilled in the art will recognize that often a manifold is cylindrical in design, and in reality a single, continuous wall may be utilized. The designations for top, bottom and side walls, however, facilitate disclosure of the invention.

In prior art internal combustion engines, a throttle valve, usually of a butterfly design, was positioned downstream of the venturi section 17 and upstream of the opening 20 in the manifold 4. The valve acted to control the fuel/air mixture flow through the passage 14 and the ports 23. As indicated above, distribution of the fuel and air mixture has not been optimized in prior art designs. To overcome this deficiency, the throttle valve of this invention modifies the housing 8 of the carburetor structure 2 so that a lower portion 24 has a first, large diameter part 25 and a second, small diameter part 26 along the opening 13 of the housing 8, the lower portion 24 itself being sized for reception in the opening 20 through the top wall 18 of the manifold 4. The diametric differences between the parts 25 and 26 delimit a stop 27, the stop 27 being useful for purposes later described.

A cylinder 28 is slidably mounted within the small diameter part 26 of the lower portion 24. Cylinder 28 has a first end 29 and a second end 30. The end 29 has a flange 31 formed in it, which is sized to ride in the large diameter part 25 of the housing 8. The flange 31, together with the stop 27 and a stop defined by a wall 77 of an upper housing portion 78, act to confine movement of the cylinder 28 to prescribed limits. In the embodiment shown, cylinder 28 is a right circular cylinder. Other cylindrical forms or tubular means are compatible with this invention. Thus, other applications may require different cross sectional shapes to effect distribution of the fluid mixture to the engine cylinders. As will be appreciated by those skilled in the art, an "in-line" engine, as shown in FIG. 1, has its carburetor on one side of the manifold 4 with all of the runners to the individual combustion chambers extending from the other side of the manifold. On the other hand, a manifold for a "V-type" engine has the carburetor mounted in a central location with runners extending along oppositely opposed directions from the carburetor location. Design of the tubular member may require modification to provide proper fluid distribution while accommodating carburetor location.

A cam means 32 is pivotally mounted at 33 and is adapted to rotate in response to movement of an arm 34. Cam means 32 abuts a lower side of flange 31, lower being referenced to FIG. 5. The arm 34 is operatively connected to a throttle command means, not shown, which may be, for example, the accelerator pedal of a conventional passenger vehicle. Engagement of the flange 31 during rotation of the cam means 32 causes the cylinder 28 to move between a first position shown in full lines in FIGS. 3–5, and a second position, shown in phantom lines in those figures.

Figure 3:
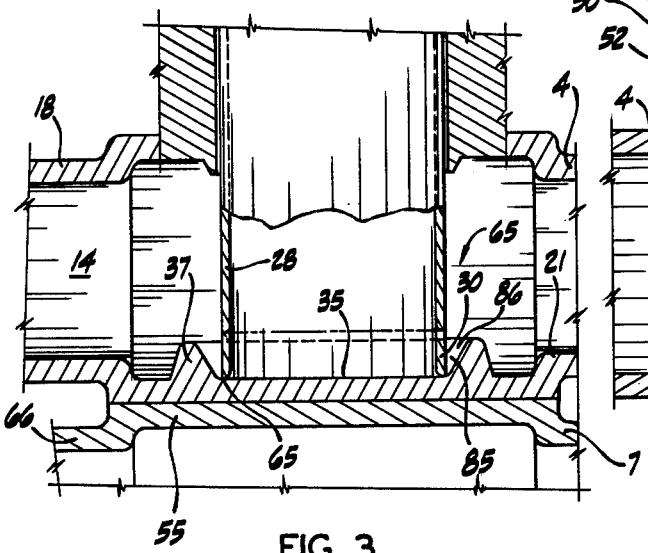
FIG. 3 is a sectional view, partly broken away, of one illustrative embodiment of throttle valve structure, used in conjunction with the engine of FIG. 1.
Figure 4:
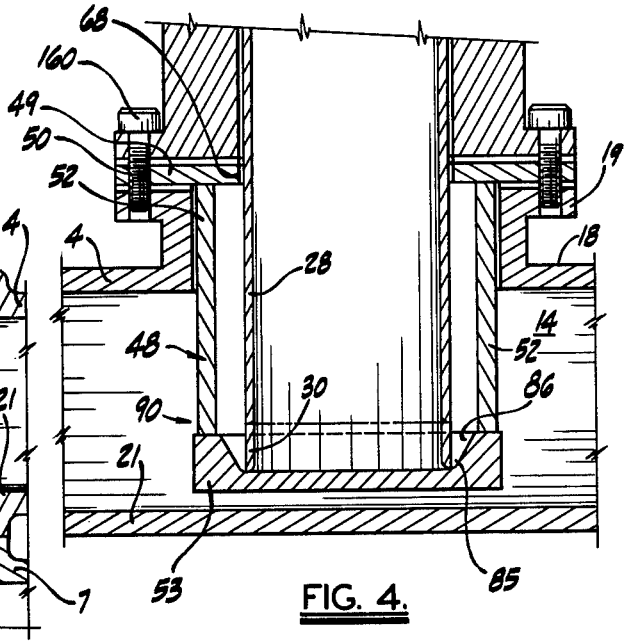
FIG. 4 is a sectional view, partly broken away, of a second illustrative embodiment of throttle valve structure of this invention.

The structure just described is common to the various embodiments of this invention shown in FIGS. 3, 4 and 5, and to the above-referenced copending applications Ser. Nos. 727,718, and 727,713. Variations shown in FIGS. 3, 4, and 5 are utilized to accomplish the objectives of this invention. Thus, for example, in FIG. 3, the cylinder 28 has an axial length chosen so that the cylinder extends into and is capable of abutting the bottom wall 21 of the intake manifold 4. As shown in FIG. 3, the bottom wall 21 has a machined area associated with it, indicated generally by the numeral 35, which ensures proper abutment of the end 30 of the cylinder 28 with the bottom wall 21. The bottom wall 21 also has an annular lip 37 formed in it, which is positioned radially outboard of the machined area 35. The lip 37 extends inwardly of the passageway 14 from the wall 21. The lip 37, together with the end 30 of the cylinder 28, define a supersonic flow area 85 and a subsonic flow area 86. The abuttment of the end 30 of the cylinder 28 with the bottom wall 21 also defines a throttle valve 65 for the carburetor 2. Movement of the cylinder 28 toward and away from the area 35 controls valve 65 operation.

Figure 2:
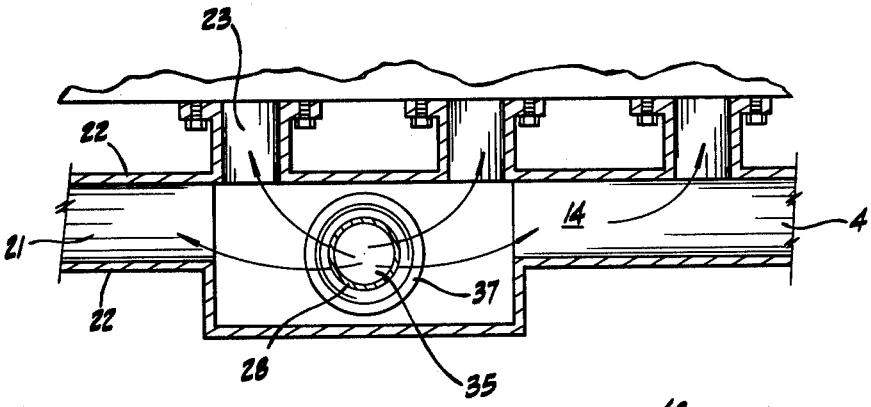
FIG. 2 is a sectional view, partly broken away, taken along the line 2—2 of FIG. 1.

As best observed in FIG. 2, use of the cylinder 28 permits fuel and air passing through the carburetor 2 to strike the bottom wall 21 along the machined area 35, and to expand radially outwardly through the supersonic flow area 85, and the subsonic flow area 86. The end 30 of the cylinder 28 preferably is beveled, as observed at 40 in FIG. 5*a*, to better define a restriction 41, so that fluid flow to the manifold 4 necessarily passes through a constriction or convergence, and thereafter passes through a divergence in the areas 85 and 86. This arrangement has offered considerably better fuel distribution to the inlet ports 23 of the manifold 4 than has been available with prior art throttle valves.

As indicated in FIG. 3, often the exhaust manifold 7 is adjacent the intake manifold 4. The material thickness of a bottom wall 21 may be varied, along the area 35, to effect more efficient heat transfer between the exhaust manifold 7 and the intake manifold 4. Heat from the exhaust manifold 7 tends to varporize liquid gasoline in the fuel and air mixture, and the liquid vaporization aids in the ability of the carburetor 2 and the throttle valve 65 of this invention to improve fuel/air mixture distribution to the ports 23.

Exhaust manifold 7 is conventional and includes a top wall 66, a bottom 55 and a pair of sides 56. The tail pipe 5 and the muffler 6 are attached to the exhaust manifold 7 by any convenient method.

FIG. 5 illustrates a variation of the method and means for providing heat transfer between the exhaust and intake manifolds. As there shown, the exhaust manifold 7 has an opening 38 formed in it. In addition, the intake manifold 4 has an opening 39 formed in the bottom wall 21, the opening 39 being axially aligned with the opening 38. The opening 39, however, is closed by a plate 95, which prevents direct communication between the intake and exhaust manifolds. Plate 95 includes a base 96 which is attached to the intake manifold 4 by any convenient method. Staking the plate 95 within the opening 39, as indicated at 42, works well, for example. A transfer cone 59 extends upwardly from the base 96. The cone 59 includes a side wall 43 extending to an apex 44 in a conventional manner. The side wall 43 surface area greatly increases the heat transfer capacity of the plate 95. That added heat transfer capacity also increases the likelihood of complete vaporization of fuel droplets in the fuel/air mixture as that mixture passes through the throttle valve 65. It should be noted that the plate 95, being symmetrical with respect to the air passage 13, enables the throttle valve 65 to maintain the radial flow characteristics of the fuel/air mixture after that mixture strikes the plate 95.

The base 96 is designed to provide the supersonic flow described above in that a wall 45 defines a first diverging area 46 for supersonic flow, and a second diverging area 47 for subsonic flow of the fuel/air mixture. The plate 95 may be constructed from a variety of materials. Sheet metal works well, for example, in that the wall 45 may be formed easily to provide the areas 46 and 47.

The carburetor structure described above utilizes a conventional venturi section 17 and air passageway 13 to draw fuel into air passing through the venturi section. Those skilled in the art will recognize that the venturi section 17 may be replaced by a nozzle 70 connected to a source of fuel through a conduit 71. The conduit 71 is provided with pressure means to pump fuel under pressure into the passageway 13 in accordance with the load demand of the engine 1 as controlled by a valve 72. Such an arrangement is illustrated in FIG. 6 and demonstrates that the throttle valve 65 of this invention is compatible with a broad range of fuel supply means.

The embodiments of the throttle valve 65 described above do require some modification in existing intake manifolds for their implementation, although that modification is considerably less than experienced with previously known prior art devices. FIG. 4 illustrates a throttle valve 90 which may be used directly with presently available intake manifold. Like numerals have been utilized for like parts, where appropriate. In the embodiment of FIG. 4, a drop-in structure 48 includes an annular flange 49. The flange 49 has a central opening 68 in it, the opening 68 being axially aligned and communicating with the passageway 13. The flange 49 also has a plurality of openings 50 in it, which receive the conventional fasteners 60 to mount the flange 49 between the housing 8 and the rim 19 of the intake manifold 4. A plurality of studs 52 are attached to the flange 49 and extend downwardly from it, so that the studs 52 project into the distribution passage 14 of the intake manifold 4. A plate 53 is attached to the studs 52 by any convenient method. For example, the studs 52 may be press fit or threaded onto the plate 53. The plate 53 and the end 30 of the cylinder 28 define the throttle valve 90 for the particular embodiment shown in FIG. 4. The plate 53 is constructed so as to provide the supersonic flow area 85, and the subsonic flow area 86, similar to that described in conjunction with the valve 65 of FIGS. 3 and 5. The advantage of this embodiment is that an entire throttle valve package may be attached to the carburetor structure 2 and inserted in the intake manifold 4, without any modification of the intake manifold. Operation of the throttle valve 90 is similar to that described for the valve 65.

Numerous variations, within the scope of the appended claims, will be apparent to those skilled in the art in light of the foregoing description and accompanying drawings. Thus, while the throttle valves 65 and 90 were described as including a cylinder 28, other geometric bodies are compatible with the broader aspects of this invention. The important consideration is that the valve action of the valves 65 and 90 occurs within the intake manifold 4, and the valves provide supersonic flow to the fuel/air mixture prior to that mixture's entrance into the cylinders of the engine 1. Likewise, various conventional structural features described in conjunction with the carburetor 2 may vary in other embodiments of this invention. For example, it is conventional to utilize a plurality of venturi sections in some carburetor designs. In like manner, independent idle circuit fuel supply means may be incorporated with the carburetor 2 in other embodiments of this invention. Presently, however, idle fuel supply is obtained by proper positioning of the cylinder 28. As indicated, an independently powered main fuel circuit may be used in place of the venturi section described. These variations are merely illustrative.

Having thus described the invention, what is claimed and described to be secured by Letters Patent is:

1. A fuel supply system for an internal combustion engine, comprising:

an intake manifold for distributing fluid to the engine, said manifold having an enclosure, said enclosure defining at least one fluid passage in said manifold;

a carburetor for supplying a fuel/air mixture to said intake manifold, said carburetor having an air passage in it operatively connected to the fluid passage of said intake manifold, fuel supply means operatively connected to said air passage, and means for combining the fuel and air in said air passage upstream of said intake manifold; and throttle valve means for controlling fluid flow through said intake manifold, said throttle valve means having an outlet positioned in said intake manifold, said throttle valve means comprising tubular means movable between a first position and a second position for controlling the area of the outlet opening, and means in said manifold for coacting with said tubular means to define a valve opening in said manifold, said manifold means and said tubular means together defining a converging section, a restriction, and a diverging section for fluid flow, said converging, restriction and diverging sections creating supersonic fluid flow conditions in said manifold in at least one operating position of said tubular means.

2. The fuel supply system of claim 1 wherein said manifold means comprises a lip integrally formed with said manifold, said lip and said tubular means defining said converging section, restriction and diverging section for fluid flow.

3. The system of claim 1 wherein said intake manifold includes a bottom wall acting to define said fluid passage, said bottom wall having an opening formed in it, said manifold opening being aligned axially with the air passage in said carburetor, and a plate, said plate being mounted to close the opening in said intake manifold, said plate including a base, said base having a wall which, with said tubular means, defines a converging section, a restriction and a diverging section for fluid flow.

4. The fluid system of claim 3 wherein said plate includes a conic section radially inboard of said base section, said conic section being symmetrically arranged with respect to said air passage.

5. The fuel system of claim 4 wherein said tubular means comprises a cylinder having a first end operatively associated with said carburetor, and a second end extending within said intake manifold, said second end coacting with said plate to enable said fuel supply system to create the supersonic fluid flow condition in said manifold.

6. The fuel supply system of claim 5 including an exhaust manifold, said exhaust manifold being positioned adjacent said intake manifold, said exhaust manifold having an opening in it permitting communication between said exhaust manifold and one side of said plate.

7. The fluid system of claim 1 wherein said throttle valve means comprises a drop-in structure adapted to extend within said intake manifold, said drop-in structure including a plate, said plate, together with said tubular means, defining a converging section, a restriction and a diverging section for fluid flow; and means for attaching said drop-in structure to said carburetor.

8. A system for supplying a uniform combustible mixture of liquid fuel and air to the intake ports of an internal combustion engine, comprising:

an intake manifold operatively connected to the intake ports, said intake manifold having a passage through it;

a carburetor for supplying a fuel/air mixture to said intake manifold, said carburetor having an air passage in it communicating with a passage in said intake manifold;

means for supplying liquid fuel to the air passage of said carburetor, said fuel supply means being connected to the air passage; and throttle means having an inlet in the air passage of said carburetor downstream of the connection between said fuel supply means and said air passage, said throttle valve means having an outlet in the passage of said inlet manifold upstream of the intake ports of the internal combustion engine, said throttle valve comprising tubular means adapted to abut a part internal of said intake manifold in a first position, and to be remote from said part in a second position, the part internal of said intake manifold passageway defining, in conjunction with said tubular means, a converging section, a restriction at the point of maximum convergence, and a diverging section downstream of the restriction, said structure creating a sonic wave in the fluid flow in said intake manifold.

9. The system of claim 8 wherein the part internal of said intake manifold comprises a wall of said manifold, said wall having a lip formed in it, said lip, together with said tubular means, defining the converging section, the restriction and the diverging section for fluid flow.

10. A system for supplying a uniform combustible mixture of liquid fuel and air to the intake ports of an internal combustion engine, comprising:

an intake manifold operatively connected to the intake ports of said engine, said intake manifold having a passageway through it, said passageway being delimited by at least one wall;

a carburetor for supplying a fuel/air mixture to said intake manifold, said carburetor having an air passage in it communicating with the passage in said intake manifold;

means for supplying liquid fuel to the air passage of said carburetor, connected to the air passage; and valve means having an inlet in the air passage of said carburetor downstream of the connection between said fuel supply means and said air passage, said valve means having an outlet in the passage of said inlet manifold upstream of the intake ports of the internal combustion engine, said valve means comprising a tubular member mounted for movement between at least a first position and a second position in said intake manifold, and a part internal of said intake manifold passage, the part internal of said intake manifold passage defining, in conjunction with said tubular member, a converging section, a restriction at the point of maximum convergence, and a diverging section downstream of the restriction, said structure creating a sonic wave in the fluid flow in at least one position of said tubular member.

11. The supply means of claim 10 wherein said movable means comprises a cylinder, said cylinder having a side wall having a material thickness, said material thickness having a chamfer associated with it so that the material thickness defines, in conjunction with the part internal of said intake manifold, the converging section and point of maximum convergence for said valve means.

* * * * *